United States Patent [19]

Keable et al.

[11] Patent Number: 5,047,795

[45] Date of Patent: Sep. 10, 1991

[54] SLOTTED PROCESSING APPARATUS AND METHOD

[75] Inventors: John B. Keable, Knoxville, Tenn.; Steve Bostic, Atlanta, Ga.

[73] Assignee: Delphi Technology, Inc., Atlanta, Ga.

[21] Appl. No.: 442,252

[22] Filed: Nov. 28, 1989

Related U.S. Application Data

[63] Continuation-in-part of Ser. No. 442,193, Nov. 28, 1989, which is a continuation-in-part of Ser. No. 330,112, Mar. 29, 1989.

[51] Int. Cl.[5] ..... G03D 3/02; G03D 3/08

[52] U.S. Cl. ..... 354/320; 354/324

[58] Field of Search ..... 354/317, 319, 320, 321, 354/322, 324, 328; 134/64 P, 122 P

[56] References Cited

U.S. PATENT DOCUMENTS

| | | | |
|---|---|---|---|
| 1,928,235 | 9/1933 | Taylor . | |
| 2,404,138 | 7/1946 | Mayer . | |
| 3,066,046 | 11/1962 | Walton . | |
| 3,344,729 | 10/1967 | Kitrosser | 134/64 P |
| 3,372,630 | 3/1968 | Schmidt | 354/324 |
| 3,405,626 | 10/1968 | Fleisher et al. | 134/122 P |
| 3,545,364 | 12/1970 | Reedy et al. | 354/319 |
| 3,610,131 | 10/1971 | Frick et al. . | |
| 3,635,144 | 1/1972 | Beck . | |
| 3,643,628 | 2/1972 | Sugarman et al. . | |
| 3,687,708 | 8/1972 | Miller . | |
| 3,752,054 | 8/1972 | Scanlan . | |
| 3,774,521 | 11/1973 | Beck . | |
| 3,873,988 | 5/1975 | Pfeifer et al. . | |
| 3,940,782 | 2/1976 | Neeb et al. . | |
| 4,142,194 | 2/1979 | Hamlin . | |
| 4,142,790 | 3/1979 | Neeb et al. . | |
| 4,145,135 | 3/1979 | Sara . | |
| 4,148,274 | 4/1979 | Stievenart et al. . | |
| 4,327,987 | 5/1982 | Friar et al. . | |
| 4,332,454 | 6/1982 | Hensel et al. . | |
| 4,421,399 | 12/1983 | Steube . | |
| 4,736,222 | 4/1988 | Stromberg . | |
| 4,758,858 | 7/1988 | Blackman et al. . | |

FOREIGN PATENT DOCUMENTS 1962441 12/1969 Fed. Rep. of Germany .

OTHER PUBLICATIONS

Stong, C. L., "Kitchen-Sink Aerodynamics," *The Scientific American*, pp. 432–438 (1960).

*Primary Examiner*—A. A. Mathews

*Attorney, Agent, or Firm*—Kilpatrick & Cody

[57] ABSTRACT

A system of substantially closed processing stations designed to disperse chemicals for uniformly coating or otherwise contacting an emulsion-coated or other surface or strip is disclosed. The system comprises one or more slotted stations through which developing chemicals are transmitted into shallow sinks. The chemicals uniformly contact the strip as it travels over the sinks and subsequently are removed from the strip along with by-products of the reaction by wipers or ribs and disposed through disposal slots in the stations. The ribs also agitate the chemicals and emulsion to assist uniform developing of the strip. Because the processing station is virtually sealed from the surrounding atmosphere, little degradation of the processing chemicals occurs even after extended periods of nonuse.

26 Claims, 3 Drawing Sheets

SLOTTED PROCESSING APPARATUS AND METHOD

CROSS-REFERENCE TO RELATED APPLICATIONS

This application is a continuation-in-part of application Ser. No. 07/442,193, filed Nov. 28, 1989, entitled "Perforated Processing Apparatus and Method," which application is a continuation-in-part of application Ser. No. 07/330,112, filed Mar. 29, 1989, entitled "Automated, Interactive Vending System for Products Which Must be Processed," both of which applications are incorporated herein in their entireties by this reference.

FIELD OF THE INVENTION

The present invention relates to applying liquid coatings to and agitating advancing substrates and more particularly to processing emulsive photosensitive materials.

BACKGROUND OF THE INVENTION

Processing photosensitive materials such as photographic film typically involves multiple steps such as developing, bleaching, fixing, rinsing, and drying the film. Because performance of these steps is well-suited for mechanization, various systems have been designed to convey long strips of film through a series of stations. Each station contains a liquid appropriate to the step to be performed at that station, with the differing liquids contacting the filmstrip sequentially as it is conveyed through the series.

The uniformity and overall quality of the processing operation is dependent upon a number of factors, including the precision with which the liquids are applied to the filmstrip, the integrity of the chemicals used, and the effectiveness of the means by which the filmstrip is protected from abrasions or other damage as it passes through the stations. U.S. Pat. No. 4,327,987 to Friar, et al., for example, discloses a mechanized processor designed to improve the transverse and longitudinal uniformity of the processed product. The processor uses a foraminous sheet of stainless steel screening positioned above the filmstrip to spread a layer of developing solution evenly across the film. The developing solution flows down a ramp until it pools on the film in an area adjacent the screen. As the film travels through the applicator the pool is compressed between the film and screen and forced away from the center of the filmstrip and toward the edges.

U.S. Pat. No. 4,332,454 to Hensel, et al. describes an applicator assembly designed both to coat the filmstrip uniformly with processing fluid and to clean its surface in a relatively gentle manner. The applicator includes an open-celled scrubber pad similar to a sponge positioned above and pressed against the film to be processed. As the film moves through the applicator, developing fluid is pumped through the scrubber pad to form a thin layer between the pad and filmstrip. Oscillation of the scrubber pad helps disperse the fluid across the entire width of the filmstrip as it removes unwanted particles. According to the Hensel, et al. patent, abrasions to the film are lessened in relation to prior systems because the pressure of the scrubber pad against the film is decreased.

While the above-mentioned film processors represent advances over traditional apparatus, a need remains for an automated system capable of providing high quality developing while maintaining the freshness of the processing chemicals over long periods of time and with intermittent utilization. Such an improved apparatus would be suitable for use in automated film processing systems as described in patent application Ser. No. 07/330,112, which function optimally when service requirements are minimized. In order for these systems to be commercially acceptable, uniform processing with minimal surface degradation of the processed film through scratching or abrading also is necessary.

The invention described in application Ser. No. 07/442,193 provides a substantially closed processing station designed to disperse chemicals for uniformly coating or otherwise contacting an emulsive or other surface. The station includes opposed chemical chambers, each of which is covered with a perforated film and, optionally, a mesh or screen-like material, between which materials the photographic print paper or film or other substrate passes. Liquid chemical solutions, mixtures, or suspensions pass into the upper chamber through a central opening and from the chamber through the perforated film onto the film surface or onto the upper screen. The liquid then passes through the upper screen if such is present and is dispersed uniformly across the substrate surface.

As the chemicals enter the upper chamber and press against the upper film it distends about its center, ensuring contact between the perforated film (or the mesh or screen) and the photographic film or other material moving through the station while minimizing the pressure on (and resulting abrading of) the substrate's surface. Excess chemicals continuously puddle beneath and beside the processed material on the lower screen to reduce friction between the material and the lower chamber. Because the station is virtually sealed from the surrounding atmosphere by the close fit between the matched peripheries of the upper and lower chambers, little degradation of the processing chemicals occurs as a result of exposure to air, even after extended periods of nonuse. Furthermore, the small volume of chemicals required to fill the processing station allows the station to be flushed quickly and with a similarly small volume of chemicals and ensures that most of the fluids in the apparatus are in its chemical reservoir rather than in processing trays or tanks if operation is interrupted.

SUMMARY OF THE INVENTION

The present invention provides another substantially closed processing system designed to disperse liquid chemical solutions, mixtures, or suspensions for uniformly coating or otherwise contacting an emulsive or other surface. The system includes one or more slotted stations through which the material to be processed passes. In one embodiment each station includes a guide plate which mates with a slotted cell and effectively seals the material against the cell. In another embodiment one or more endless belts traveling adjacent to the station may be used to seal the material against the slotted cell and, in some multi-station processors, alter the direction of travel of the material. Yet another embodiment for processing two sides of a material comprises opposed slotted cells which together operate effectively to seal the material within the station.

Each slotted cell contains a series of slits forming the leading edges of sinks in which chemicals may puddle against the emulsion-coated side of the material. Disposal slots through which spent chemicals may exit define the trailing edges of all but the last sink in a cell, whose trailing edge is the edge of the cell itself. In one embodiment one or more ribs may be positioned within the sinks to agitate and wipe chemicals and processing by-products from the material. A fluid transfer block adjacent the slotted cell serves to transfer a metered supply of chemicals to the slits and, if desired, control the temperature of the processing station.

The cellular, ribbed arrangement of the present invention and travel of the material assisted by the guide plates or belts ensures a high rate of agitation of emulsion and developing chemicals. The substantially continuous introduction of chemicals to and rapid removal of the chemicals from the material as it travels the length of each cell prevents residual waste materials and chemical reaction by-products from remaining on the surface of the strip. Because each station is virtually sealed from the surrounding atmosphere by the combination of material and guide plate or belt, little degradation of the processing chemicals occurs as a result of exposure to air, even after extended periods of nonuse. Furthermore, the small volume of chemicals required to fill each processing station allows the station to be flushed quickly and with a similarly small volume of chemicals and ensures that most of the fluids in the apparatus are in its chemical reservoirs rather than in processing trays or tanks if operation is interrupted.

It is therefore a object of the present invention to provide a system for substantially continuously dispersing fluids uniformly onto one or more surfaces of an advancing material and rapidly removing those fluids.

It is an additional object of the present invention to provide a system for ensuring contact between and agitation of an advancing material and fluids such as developing chemicals.

It is yet an additional object of the present invention to provide a system for maintaining the integrity of any chemicals to be used to contact an advancing material over long periods of time.

Other objects, features, and advantages of the present invention will become apparent with reference to the remainder of the written portion and the drawings of this application.

DETAILED DESCRIPTION OF THE DRAWINGS

Figure 1:
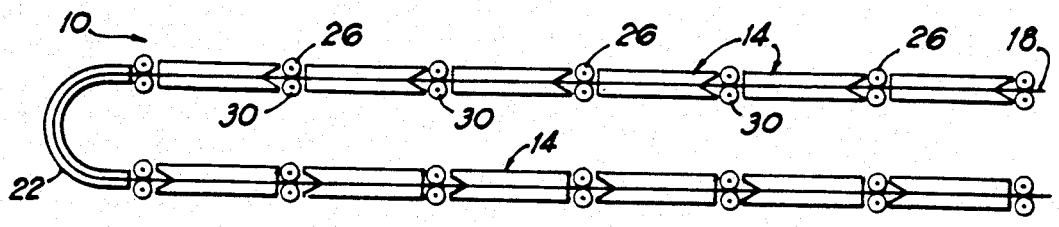
FIG. 1 is a schematic representation of a series of processing stations in a processing apparatus of the present invention.

FIG. 1 details a processing apparatus 10 comprising series of processing stations 14 through which an emulsion-bearing material or strip 18 such as photographic print paper, plates, or film, x-ray film, or graphic arts material passes during development. If some of stations 14 are located above and aligned with other stations 14 (shown inverted in FIG. 1), a U-shaped guide 22 (FIGS. 1 and 9) or other pivot mechanism such as a roller may be used to alter the direction of travel of the strip 18 and allow it to pass through the lower row of stations 14. Guide 22 also may function as a processing station if desired. Opposed nip rollers 26 and 30 are located intermediate adjacent stations 14 for advancing the strip 18 and may be driven by any suitable motors. Suitable positioning of rollers 26 and 30 creates a self-threading drive mechanism for advancing strip 18 through apparatus 10.

Stations 14 may be mounted on any appropriate base or object using conventional means. A collection tray or drain may be installed to prevent fluid or other waste associated with any of stations 14 from dripping onto equipment or other stations 14 and interfering with the developing process. A self-threading system of the type used in a photographic processing minilab leader tab system may be used to feed strip 18 to the counter-rotating rollers 26 and 3 associated with the first processing station 14 in the series. Those skilled in the art will recognize, however, that other threading systems may be used depending on the type of material being processed, and that leaders or splicing may not be required.

Although FIG. 1 illustrates twelve stations 14, the number of stations needed to complete a processing operation similarly depends at least in part on the type of material being processed. Dental x-rays, for example, may be processed using a single station in some cases. In contrast, the twelve stations shown in FIG. 1 may be suitable for processing standard 35 mm film. Because the number of stations 14 of apparatus 10 may be varied for different applications, however, the present invention is not be limited to any particular quantity.

Figure 2:
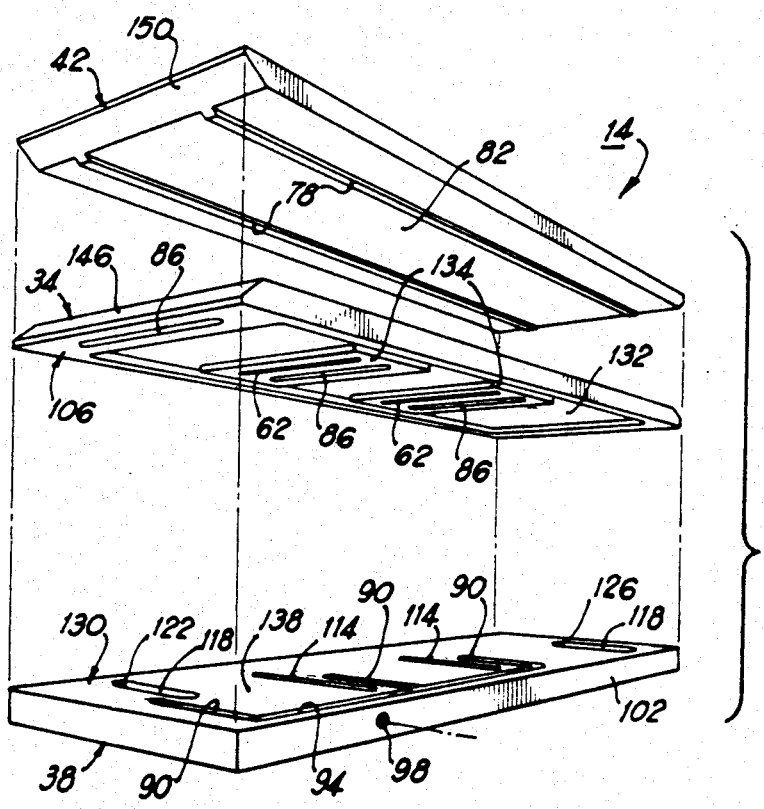
FIG. 2 is an exploded perspective view of a single processing station from FIG. 1.
Figure 3:
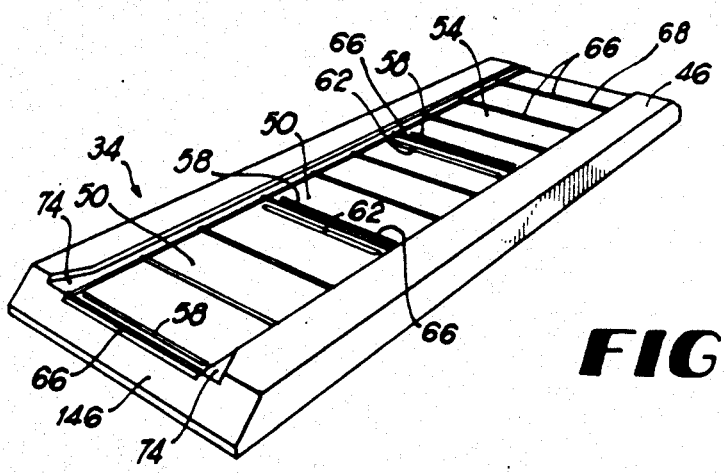
FIG. 3 is a perspective view of the slotted cell forming a portion of the processing station of FIG. 2.
Figure 4:
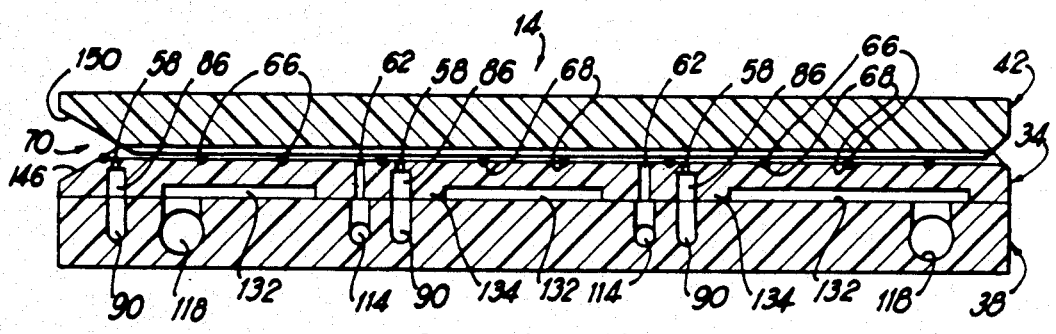
FIG. 4 is a cross sectional view of the processing station of FIG. 2.

Referring to FIGS. 2–4, each processing station 14 includes slotted cell 34, fluid transfer block 38, and guide plate 42. FIG. 3 details the upper surface 46 of cell 34, which surface 46 comprises a series of shallow sinks 50 and 54 positioned longitudinally along cell 34 in which processing chemicals may puddle. One or more narrow slits 58 transverse to the direction of travel of strip 18 at least partially form the leading edges of each sink 50 and 54, while wider transverse disposal slots 62 substantially define the trailing edges of sinks 50. The trailing edge of sink 54, in contrast, is demarcated by the trailing edge of station 14 itself. Although FIGS. 2–4 illustrate three sinks 50 and 54 of varying lengths associated with station 14, neither the number nor relative lengths of the sinks is critical to the invention.

Extending the width of each sink 50 and 54 are wipers or ribs 66 functioning to agitate and wipe chemicals and processing by-products from strip 18. In the embodiment of FIGS. 3–4 ribs 66 are cylindrically shaped and fitted in rib grooves 68 parallel to slits 58 and disposal slots 62 and transverse to the direction of travel of the strip 18. In other embodiments ribs 66 may be oriented differently, however, including diagonally across sinks 50 and 54. Ribs 66 similarly may be wedge-shaped or otherwise configured if necessary to wipe and agitate a particular strip 18 appropriately. FIGS. 3–4 also illustrate ribs 66 placed at the mouth or entrance 70 to station 14 and between the trailing and leading edges of adjacent sinks 50 and 54 to prevent chemicals from spilling from sinks 50 and 54 into adjacent sinks or out of the station 14. Like their shape and orientation, however, the number of ribs 66 and their positions relative to and within sinks 50 and 54 may vary depending on the processing application involved.

Upper surface 46 also includes longitudinal grooves or tracks 74 extending the length of cell 34. Corresponding protrusions 78 traversing the length of guide plate 42 engage tracks 74, creating a close fit between the peripheries of cell 34 and plate 42 as shown in FIG. 4. Because sinks 50 and 54 are cut deeper than tracks 74, however, a shallow space 82 exists in stations 14 through which the material 18 may travel.

Slits 58 and disposal slots 62 extend throughout the depth of cell 34. Slits 58, which widen below upper surface 46 to form open-bottomed reservoirs 86 (FIGS. 2–4), receive developing chemicals into the reservoirs 86 through communication with feeder grooves 90 of block 38. Feeder grooves 90 in turn are fed from longitudinal groove 94, which also communicates with bore 98 located in a first side 102 (FIG. 2) of block 38. Appropriate means such as hoses or tubing (and metering devices if desired) may be used to cause developing chemicals disposed remotely from processing apparatus 10 to flow into bore 98, and block 38 may be fastened to the lower surface 106 of cell 34 using conventional means, including adhesive or screws. Fastening block 38 to lower surface 106 seals the bottoms of reservoirs 86. Combined with plate 42 and material 18 (when present), block 38 effectively seals cells 14, reducing degradation of fresh developing chemicals entering through bore 98 due to exposure to the surrounding environment even after extended periods of nonuse. The small volume of chemicals required to fill each processing station 14 also allows the station 14 to be flushed quickly and with a similarly small volume of chemicals and ensures that most of the developing fluids associated with apparatus 10 are in remote chemical storage tanks or reservoirs rather than in the processing stations 14 if operation is interrupted.

Block 38 also includes disposal grooves 114, transfer grooves 118, inlet 122, and outlet 126. Disposal grooves 114 align with disposal slots 62 and carry used chemicals and other waste to a second side 130 of block 38, from where the chemicals may be removed (and recycled into apparatus 10 if appropriate) using any suitable means. Inlet 122 and outlet 126, with their associated transfer grooves 118, allow heated fluid to circulate through station 12 in recessed region 132 forming part of the lower surface 106 of cell 34. Islands 134 in recessed region 132 are designed to rest flush with the upper surface 138 of block 38, sealing the chemicals entering and exiting station 12 from the heated fluid. By circulating heated fluid through recessed region 132, station 12 may be maintained at any desired temperature. As those skilled in the art will recognize, the initial heating requirements and quantity of fluid necessary to maintain a particular temperature may be reduced if appropriate heat-retaining substances are chosen for cell 34 and block 38.

Processing of strip 18 commences as the strip 18 is fed to mouth 70 of the first (if more than one) processing station 14. Developing chemicals metered or otherwise transmitted to station 14 through bore 98 pool in reservoirs 86 and seep through slits 58 into sinks 50 and 54. Strip 18, guided into space 82 by rollers 26 and 30 and protrusions 78, passes along the upper surface 46 of cell 34 with its emulsion-coated side facing the surface 46. Movement of strip 18 allows developer from a sink 50 or 54 to contact the emulsion-coated side and permits agitation of the developing chemicals and emulsion to assist uniform developing of the strip 18. Strip 18 also passes over ribs 66, which agitate the emulsion and wipe away the most of the chemicals deposited on the strip 18 through slits 58 as well as chemical reaction by-products. The removed chemicals are redeposited in the next section of sink 50 or 54 and eventually drained through disposal slots 62 for disposal or recycling in apparatus 10. This process is repeated substantially identically with the other sinks 50 and 54 of each station 14 in the series. Because no rib 66 follows the trailing edge of sinks 54, however, excess chemicals and by-products present on portions of strip 18 passing over sinks 54 either drain between stations 14 or are removed by the wiping or squeegee action of rollers 26 and 30 immediately downstream from each station 14.

The substantially continuous introduction of developing chemicals to and rapid removal of the chemicals from the strip 18 as the emulsion-coated surface travels the length of each cell 34 serves to improve the overall developing process, as it prevents residual waste materials and chemical reaction by-products from remaining on the emulsion-coated surface of the strip 18 for any significant periods of time. The developing chemicals also serve to lubricate the surface, facilitating transport of strip 18 through apparatus 10 and minimizing surface abrasions. Furthermore, each sink 50 and 54 may have a separate bore or inlet, allowing different processing chemicals to be used simultaneously in the same cell 34.

In an embodiment of the invention designed to develop 35 mm film and consistent with FIG. 1, cells 34 are typically 5.87″×2.25″×0.312″ and, along with blocks 38 and plates 42, are made of hard plastic. Sinks 50 and 54 are approximately 1.2″ wide and 0.032″ deep, with ribs 66 positioned 0.5″ apart within the sinks. Reservoirs 130 and rib grooves 56 may be 0.09″ and 0.07″ deep, respectively. Bore 98 has diameter 0.140″, while inlet 122 and outlet 126 are approximately 0.280″ in diameter. Disposal grooves 114 extend into block 38 to a depth of 0.25″, and feeder grooves 90 may have a depth of 0.12″.

Also in this embodiment, developing chemicals are fed to the six stations 14 of the upper row and the first two lower stations 14 contacted by strip 18 are fed with fixer chemicals, the next two with bleach, and the final two with stabilizer. Mouth 70 and the respective leading edges 146 and 150 of cell 34 and plate 42 may be bevelled to assist travel of strip 18 through apparatus 10. Ribs 66 may be made of steel and, as discussed above, fitted in rib grooves 68, although other suitable materials may be used and ribs 66 may be molded as part of cell 34 instead.

Figure 5:
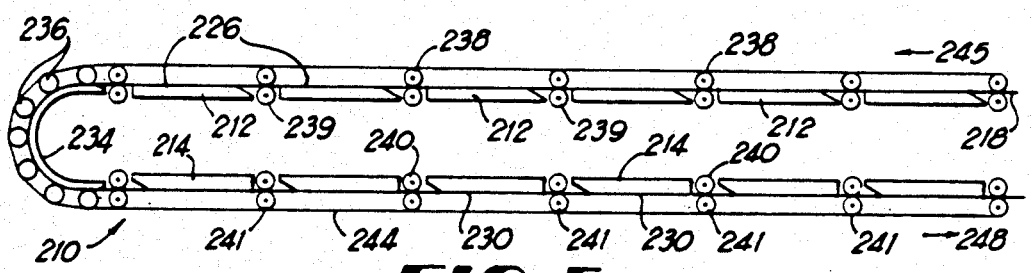
FIG. 5 is a schematic representation of a series of processing stations in an alternative processing apparatus of the present invention.

FIG. 5 details an alternative processing apparatus 210 comprising series of upper and lower processing stations 212 and 214, respectively, through which an emulsion-bearing substrate or strip 218 similar to strip 18 passes during development. Strip 218 is fed into processing apparatus 210 so that its emulsion-coated surface or side 222 faces the upper surfaces 226 of upper processing stations 212 and the lower surfaces 230 of lower processing stations 214. If upper processing stations 212 are located above and aligned with lower processing stations 214 (as shown in FIG. 5), a U-shaped guide 234 and rollers 236 or other pivot mechanisms such as U-shaped guide 22 may be used to alter the direction of travel of the strip 1 and position its emulsion-coated side 222 appropriately for contact with the lower surfaces 230 of the lower processing stations 214.

Opposed nip roller pairs 238 and 239 and 240 and 241 are located intermediate adjacent processing stations 212 and 214 and, like nip rollers 26 and 30, may be driven by any suitable motors. Endless belt 244 encircles outer rollers 238 and travels incrementally in response to counter-rotation of the rollers 238 and 239, guiding strip 218 longitudinally over surface 226 (as illustrated by arrow 245 in FIG. 5). Similarly, belt 244 encircles outer rollers 241 and guides strip 218 in the opposite direction (illustrated by arrow 248) responsive to counter-rotation of the rollers 240 and 241. The combination of nip rollers 238–241 and endless belt 244 separated from surfaces 226 and 230 by strip 218 bias the emulsion-coated side 222 of the strip 218 against the surfaces 226 and 230. Biasing strip 218 toward surfaces 226 and 230 of processing stations 212 and 214 allows the strip to contact developing chemicals transmitted through those stations to their surfaces.

Figure 6:
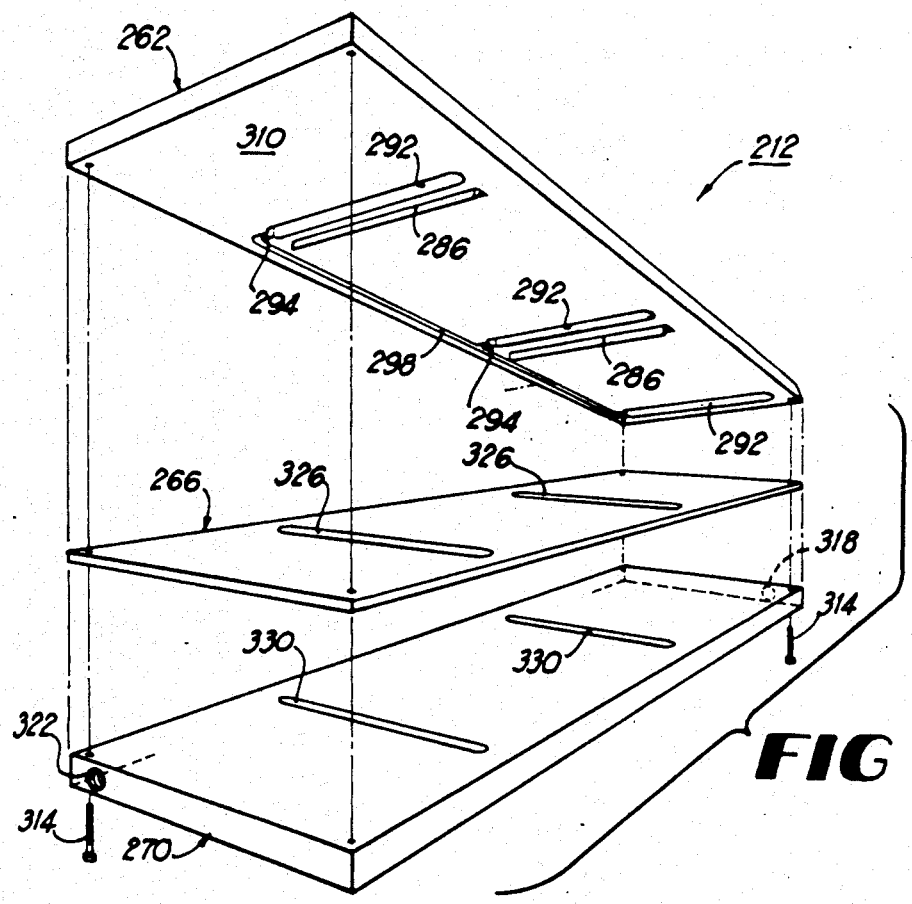
FIG. 6 is an exploded perspective view of a single alternative processing station from FIG. 5.
Figure 7:
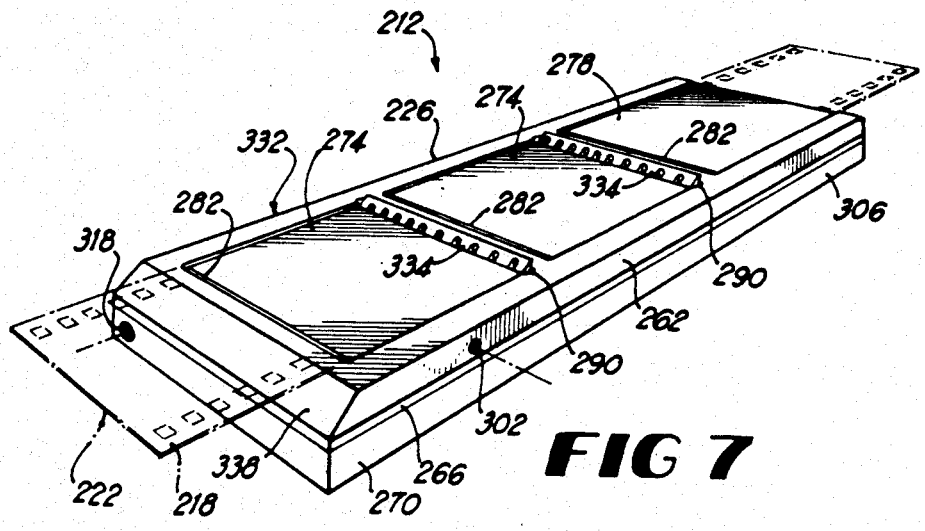
FIG. 7 is a perspective view of the alternative slotted cell forming a portion of the alternative processing station of FIG. 6.
Figure 8:
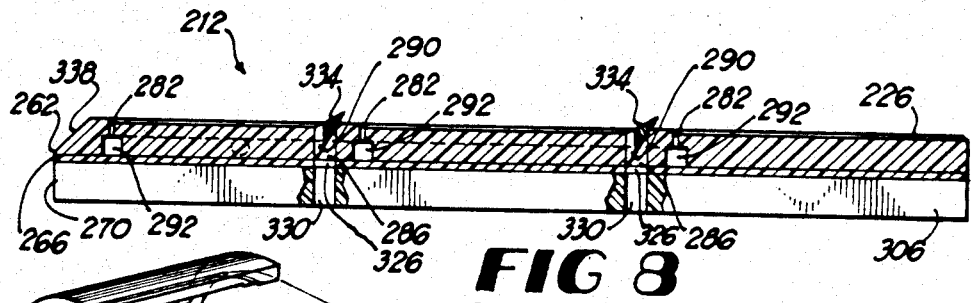
FIG. 8 is a cross sectional view of the alternative processing station of FIG. 6.

Referring to FIGS. 6–8, each upper processing station 212 includes a cell 262, plate 266, and cavity or reservoir 270. FIGS. 6 and 8 detail the upper surface 226 of station 212 (and cell 262), which surface comprises a series of shallow sinks 274 and 278 positioned longitudinally along cell 262 in which processing chemicals may puddle. Narrow slits 282 transverse to the direction of travel of strip 218 form the leading edges of each sink 274 and 278, while wider transverse disposal slots 286 define the trailing edges of sinks 274. The trailing edge of sink 278, in contrast, is demarcated by the trailing edge of station 212 itself. Similar to sinks 50 and 54, neither the number nor relative lengths of the sinks 274 and 278 is critical to the invention. In addition, a wiper 290 may be placed within each disposal slot 286 so that an approximately right-triangular portion protrudes above upper surface 226, and slot 286 is substantially (but not completely) filled by the wiper 290.

As shown in FIGS. 6 and 8, slits 282 and disposal slots 286 extend throughout the depth of station 212. Slits 282, which widen below upper surface 226 to form open-bottomed reservoirs 292, receive developing chemicals into the reservoirs 292 through communication at one end with feeder grooves 294. Feeder grooves 294 in turn are fed from longitudinal groove 298, which also communicates with bore 302 located in one side 306 of station 212. Appropriate means such as hoses or tubing (and metering devices if desired) may be used to cause developing chemicals disposed remotely from processing apparatus 210 to flow into bore 302, and plate 266 may be fastened to the lower surface 310 of cell 262 using conventional means such as adhesive or screws 314. Fastening plate 266 to lower surface 310 seals the bottoms of reservoirs 292. Combined with the bias of endless belt 244 and strip 218 (when present) toward upper station 212, as noted above, plate 266 effectively seals cell 262, reducing degradation of fresh developing chemicals entering through bore 302 due to exposure to the surrounding environment even after extended periods of nonuse. The small volume of chemicals required to fill each processing station 212 also allows the station 212 to be flushed quickly and with a similarly small volume of chemicals and ensures that most of the developing fluids associated with apparatus 210 are in remote chemical storage tanks or reservoirs rather than in the processing stations 212 if operation is interrupted.

Reservoir 270, for circulating hot water or other fluid through apparatus 210, fastens to plate 266 using screws 314 or other suitable fastening means. Inlet 318 and outlet 322 on opposite sides of reservoir 270 allow heated fluid to pass through the reservoir 270 without contacting developing chemicals entering cell 262 through bore 302. If plate 266 is made of a heat-conducting material such as metal, heat from the fluid in reservoir 270 may pass through plate 266 and warm the processing chemicals and cell 262 to appropriate temperatures.

FIGS. 6 and 8 also illustrate corresponding drain openings 326 and 330 which may be included in plate 266 and reservoir 270, respectively. A set of drain openings 326 and 330 aligns with each disposal slot 286 to drain used chemicals from cell 262 while insulating fresh chemicals in the cell 262 from the used chemicals. Any drain mechanism may be used, however, to remove spent chemicals from the immediate vicinity of cell 262. Disposal slots 286, for example, alternatively may be extended laterally to the side 332 of station 212 opposite side 306, thereby allowing used developing chemicals to exit cell 262 through the side 332 rather than through lower surface 310.

Apparatus 210 typically comprises up to six upper stations 212, each of which stations 212 supplies liquid developer to a strip 218. As strip 218 is fed to first upper processing station 212, developer metered or otherwise transmitted to the station 212 through bore 302 pools in reservoirs 292 and seeps through slits 282 into sinks 274 and 278. Strip 218, guided by endless belt 244, passes along the upper surface 226 of processing station 212 with its emulsion-coated surface 222 facing the surface 226. Movement of strip 218 allows developer from a sink 274 to contact emulsion-coated surface 222 and agitates the developer and emulsion to assist uniform developing of the strip 218. Strip 218 then passes over the sloping surface 334 of wiper 290, allowing developer deposited on the strip 218 through slit 282 and chemical reaction by-products to be removed and drained through disposal slot 286. This process is repeated substantially identically with the other sinks 274 and 278 of each upper processing station 212. Because the trailing edge of sink 278 contains no wiper 290 in the embodiment of FIGS. 7–8, however, excess chemicals and by-products present on portions of strip 218 passing over sinks 278 either drain between processing stations 212 or are removed by the wiping or squeegee action of rollers 238 and 239 immediately downstream from the processing station 212. The substantially continuous introduction of developing chemicals to and rapid removal of the chemicals from the strip 218 as surface 222 travels the length of each cell 262 serves to improve the overall developing process, as it prevents residual waste materials and chemical reaction by-products from remaining on the emulsion-coated surface 222 of the strip 218 for any significant periods of time.

Lower developing stations 214 (FIG. 5), when present, function similarly to their upper counterparts. Like upper stations 212, each lower station 214 includes a cell, heat-conductive plate, and hot water or other fluid containing cavity or reservoir. Because strip 218 passes below lower stations 214, however, arrangement of their components is opposite that of upper stations 212. As shown in FIG. 5, when fastened together each reservoir is disposed above its corresponding plate, which plate in turn is located above each corresponding cell. Chemicals entering the cell through pass through longitudinal and feeder grooves similar to the feeder system for upper stations 212, and contact strip 218 through slits associated with reservoirs similar to slits 282 and reservoirs 292.

Because gravity helps ensure contact between developing chemicals and the emulsion-coated side 222 of strip 218, however, lower stations 214 typically need not include sinks, disposal slots, and wipers. Excess chemicals instead will drip from the edges of strip 218 onto the edges of endless belt 244, from which edges the chemicals may merely drain into a tray or other suitable collection means.

In the embodiment of the invention shown in FIG. 5 the first two lower stations 214 contacted by strip 218 are fed with fixer chemicals, the next two with bleach, and the final two with stabilizer. The leading edges 338 of stations 212 and 214 may be beveled to assist travel of strip 218 through apparatus 210. Additionally, rollers 238 and 241 may be undercut slightly to accommodate endless belt 244, which belt may be made of 0.008–0.010" thick mylar or polyester and ultrasonically welded to have no seams. Sinks 274 and 278 may have a depth of approximately 0.010", and wiper 290 may be made of rubber or soft plastic. If apparatus 210 is used for processing 35 mm photographic film, belt 244 also may be made approximately one and one-half inches wide, slightly wider than strip 218 (which typically is one and three-eighths inches wide) and sinks 274 and 278 to assist in sealing cell 262. Cell 262 for processing 35 mm photographic film is typically $5\frac{3}{4}'' \times 2\frac{1}{4}'' \times \frac{1}{4}''$ and may be made of hard plastic.

Figure 9:
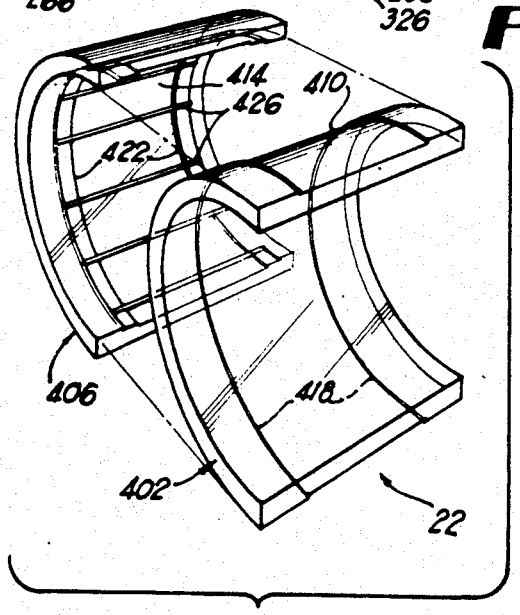
FIG. 9 is an exploded perspective view of the guide forming a portion of the processing apparatus of FIGS. 1 and 5.

FIG. 9 illustrates a U-shaped guide 22 which may be used as a pivot mechanism with any of the multiple row embodiments such as those shown in FIGS. 1 and 5. Guide 22, which may be mounted to any appropriate surface or object using conventional means, includes interior and exterior guide members 402 and 406, respectively, through which strip 18 or 218 passes during development. The surfaces 410 and 414 of guide members 402 and 406 facing strip 18 may include longitudinally-extending grooves 418 and 422 slightly larger than the width of strip 18 or 218 to facilitate movement of the strip through guide 22. The peripheries of guide members 402 and 406 also are designed to fit flush, effectively sealing the interior surfaces 410 and 414 from the surrounding environment. The sealed nature of guide 22 allows it too to function as a processor, much like either of cells 34 and 262. Although not shown in FIG. 9, either or both of guide members 402 or 406 may include one or more inlets (and slits 426) for transmitting developing chemicals to strip 18 or 218.

Figure 10:
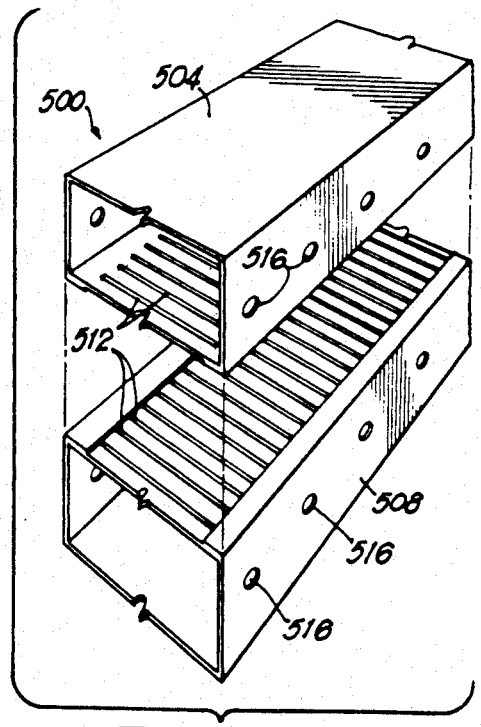
FIG. 10 is an exploded perspective view of a dryer station which may be used in connection with the processing apparatus of FIGS. 1–9.

A dryer section also may be added following the final station 14, 212, or 214 or apparatus 10 or 210. Such section could consist of one or more dryer stations 500 (FIG. 10) made of extruded aluminum or other heat-conducting material through which strip 18 or 218 passes. Heated, pressurized air may be forced through upper and lower chambers 504 and 508, respectively, of dryer station 500, exiting through slots 512 onto both sides of strip 18 or 218 and creating laminar flow to assist transport of the strip 18 or 218 through the dryer station 500. Ports 516 in chambers 504 and 508 may be used to aid the removal of moisture from the air in the chambers. Alternatively, strip 18 or 218 could pass through one or more infrared heating cells positioned ajdacent one or both sides of the strip 18 or 218 and dryer station 500 used to allow cool or warm air forced through slots 512 to contact the sides of strip 18 or 218. Another alternative dryer section could comprise a series of opposed nip roller pairs substantially similar to pairs 26 and 30, 238 and 239, or 240 and 241 positioned in a region where heated air is passed by strip 18 or 218.

The foregoing is provided for purposes of illustration, explanation, and description of embodiments of the present invention. Consistent with the objectives of the invention, vibrators may be attached to any of stations 14, 212, and 214 to cause slight linear movement of the stations relative to the strip 18 or 218 and facilitate motion of the chemicals in the desired direction. Stations 14, 212, 214, and 500 may be transparent to various forms of light to allow reexposure or infrared or ultraviolet drying of strip 18 or 218 during the process herein described. The invention also contemplates that stations 14, 212, 214, and 500 may be of any width suitable for processing any type of photographic, x-ray, graphic arts, or other material. If strip 18 or 218 contains emulsion on both sides, stations 14, 212, and 214 may be adapted so that developing chemicals contact both sides of the strip 18 or 218. Either fresh or reused developing chemicals may be metered or otherwise transmitted into stations 14, 212, and 214, and such chemicals, which may differ both in type and freshness between adjacent stations in any series of stations, may be continuously circulated through a tank or reservoir. Additional modifications and adaptations to the embodiments will be apparent to those of ordinary skill in the art and may be made without departing from the scope or spirit of the invention. Moreover, because stations 14 and 500 may be oriented (and developing and drying may occur) in any plane, words such as "upper," "lower," "top," and "bottom" are used only for convenience in referring to components shown in FIGS. 1–4 and 9–10 and do not limit the invention in any way. These words also may be used interchangeably with respect to stations 212 and 214, although stations 214, if present in an embodiment, must be oriented so that gravity causes developing chemicals to flow onto strip 218.

We claim:

1. An apparatus for processing a photographic emulsion comprising:

a. means for delivering a photographic processing chemical through an opening for contact with the emulsion;

b. a sink having an edge at least partially defined by the opening and in which photographic processing chemical may puddle; and c. at least one rib positioned within the sink for agitating and removing at least a portion of the photographic processing chemical from the emulsion.

2. An apparatus according to claim 1 further comprising means for drying the emulsion.

3. An apparatus according to claim 1 in which the sink has a trailing edge at least partially defined by a slot, for draining photographic processing chemical from the sink and the emulsion.

4. An apparatus according to claim 1 in which the delivering means comprises a cell comprising:

a. means receiving a photographic processing chemical; and b. a groove communicating with the receiving means and the slit for transmitting photographic processing chemical from the receiving means through the slit to the sink.

5. An apparatus according to claim 1 in which the photographic processing chemical is metered so as to be delivered in low volume, for facilitating any movement of the emulsion relative to the sink.

6. An apparatus according to claim 2 in which the means for drying the emulsion comprises means selected from the group consisting of:

a. means for exposing the emulsion to heated air;

b. means for exposing the emulsion to infrared radiation; and c. means for exposing the emulsion to ultraviolet radiation.

7. An apparatus for processing a photographic emulsion comprising a cell positionable adjacent the emulsion, which cell comprises:

a. a side defining an opening for receiving a photographic processing chemical;

b. a surface comprising at least one sink, which sink comprises a leading edge at least partially defined by a slit and a trailing edge at least partially defined by a slot, which slit and slot extend at least partially through the cell; and c. at least one groove communicating with the opening and the slit, for transmitting photographic processing chemical through the slit to the sink for contact with the emulsion.

8. An apparatus according to claim 7 further comprising means for agitating and removing at least a portion of the photographic processing chemical from the emulsion.

9. An apparatus according to claim 7 further comprising means, communicating with the slot, for draining photographic chemical from the sink and the emulsion.

10. An apparatus according to claim 7 further comprising a reservoir for circulating heated fluid through the apparatus.

11. An apparatus according to claim 7 further comprising a plate positionable opposite the emulsion from the cell for substantially sealing the emulsion against the surface of the cell.

12. An apparatus according to claim 7 further comprising a belt positionable opposite the emulsion from the cell for substantially sealing the emulsion against the surface of the cell.

13. An apparatus according to claim 8 in which the agitating and removing means comprises a wiper.

14. An apparatus according to claim 8 in which the agitating and removing means comprises at least one rib positioned within the sink.

15. An apparatus for processing a photographic emulsion comprising:

a. a first cell positionable adjacent the emulsion comprising:

i. a side defining an opening for receiving a photographic processing chemical;

ii. a rear edge;

iii. a first surface comprising:

A. a first sink, which sink comprises a leading edge at least partially defined by a first slit and a trailing edge at least partially defined by a slot; and B. a second sink, which sink comprises a leading edge at least partially defined by a second slit and a trailing edge defined by the rear edge of the cell, which first and second slits and slot extend at least partially through the cell;

iv. a first groove communicating with the opening; and v. second and third grooves communicating with the first and second slits, respectively, and each communicating with the first groove for transmitting photographic processing chemical through the first and second slits to the first and second sinks;

b. a second cell positionable adjacent the emulsion, comprising:

i. a side defining an opening for receiving a photographic processing chemical;

ii. a second surface comprising a third slit which extends at least partially through the cell to the second surface; and iii. a fourth groove communicating with the third slit and the opening for transmitting photographic processing chemical through the third slit; and c. means for guiding the emulsion adjacent the first and second sinks and third slit in contact with the photographic processing chemicals associated with the first and second cells.

16. An apparatus according to claim 15 further comprising at least one wiper associated with each of the first and second slits of the first cell, for removing photographic processing chemical from the emulsion.

17. An apparatus according to claim 15 further comprising means for altering the direction of travel of the emulsion between the first and second cells.

18. An apparatus according to claim 16 in which the guiding means comprises at least one endless belt associated with at least one pair of opposed, counter-rotating rollers through which the emulsion passes.

19. An apparatus according to claim 17 further comprising third through seventh cells comprising components substantially identical to the first cell and eighth through twelfth cells comprising components substantially identical to the second cell.

20. A method for processing a photographic emulsion comprising the steps of:

a. passing the emulsion adjacent a sink having a leading edge at least partially defined by a first slit through which a photographic processing chemical may pass onto the emulsion; and b. agitating and removing at least a portion of the photographic processing chemical from the emulsion by contacting the emulsion with at least one rib positioned within the sink.

21. A method according to claim 20 further comprising the step of:

c. passing the emulsion adjacent a cell having a second slit through which a photographic processing chemical may pass.

22. A method according to claim 20 further comprising the steps of:

c. repeating step (a); and d. repeating step (b).

23. A method according to claim 21 further comprising the step of:

d. altering the direction of travel of the emulsion between the sink and cell.

24. A method according to claim 20 further comprising the steps of:

c. prompting a patron to provide information relating to the patron's identity;

d. recording the information provided on a memory means located within an unmanned apparatus;

e. prompting the patron to deposit a light-resistent cartridge containing the photographic emulsion into the unmanned apparatus; and f. removing the photographic emulsion from the light-resistent storage container.

25. An apparatus for processing a photographic emulsion comprising:

a. means for delivering a photographic processing chemical through an opening for contact with the emulsion; and b. a sink having a first edge at least partially defined by the opening and in which photographic processing chemical may puddle and a second edge at least partially defined by a slot, for draining photographic processing chemical from the sink and the emulsion.

26. An apparatus according to claim 25 in which the delivering means comprises:

a. means for receiving a photographic processing chemical; and b. a groove communicating with the receiving means and the slit for transmitting photographic processing chemical from the receiving means through the slit to the sink.

* * * * *